United States Patent [19]

Dolison

[11] Patent Number: 4,779,671

[45] Date of Patent: Oct. 25, 1988

[54] COOLING, HEATING AND VENTILATION SYSTEM

[76] Inventor: Dewey Dolison, 4645 SW. 64th Ave., Miami, Fla. 33155

[21] Appl. No.: 58,314

[22] Filed: Jun. 5, 1987

[51] Int. Cl.[4] ..... F25B 29/00

[52] U.S. Cl. ..... 165/16; 165/48.1; 165/59; 62/411; 62/412; 62/428; 236/49; 98/33.1; 98/34.5; 98/34.6

[58] Field of Search ..... 165/16, 48.1, 48.2, 165/59; 98/33.1, 34.5, 34.6; 62/411, 412, 428; 236/49 D

[56] References Cited

U.S. PATENT DOCUMENTS

| | | | |
|---|---|---|---|
| 1,925,822 | 9/1933 | Shurtleff . | |
| 2,188,566 | 1/1940 | Cowderoy-Dale | 165/48.1 |
| 2,224,878 | 12/1940 | Morrison | 62/411 |
| 2,892,324 | 6/1959 | Quick | 165/16 |
| 3,366,165 | 1/1968 | Beeler . | |
| 3,401,621 | 9/1968 | Aaberg | 98/34.5 |
| 3,742,837 | 7/1973 | Samuelsson | 98/33.1 |
| 3,802,327 | 4/1974 | Otsuka | 98/33.1 |
| 3,804,156 | 4/1974 | McDonough | 98/33.1 |
| 3,949,809 | 4/1976 | Gilles | 165/48.1 |
| 4,062,400 | 12/1977 | Horowitz | 98/34.6 |
| 4,126,269 | 11/1978 | Bruges | 236/49 |
| 4,175,401 | 11/1979 | McManus | 236/49 D |
| 4,307,776 | 12/1981 | Grün et al. | 98/33.1 |
| 4,373,576 | 2/1983 | Strupczewski | 165/48.1 |
| 4,391,321 | 7/1983 | Thunberg | 98/33.1 |
| 4,526,227 | 7/1985 | Baker | 165/48.1 |

FOREIGN PATENT DOCUMENTS

| | | | |
|---|---|---|---|
| 493428 | 6/1953 | Canada | 165/48.1 |
| 2435952 | 2/1976 | Fed. Rep. of Germany | 98/33.1 |
| 2721434 | 11/1978 | Fed. Rep. of Germany | 165/16 |
| 2915260 | 10/1980 | Fed. Rep. of Germany | 236/49 |
| 8005841 | 5/1982 | Netherlands | 98/33.1 |
| 125865 | 5/1928 | Switzerland | 98/33.1 |

*Primary Examiner*—Albert W. Davis, Jr.
*Assistant Examiner*—John K. Ford
*Attorney, Agent, or Firm*—John Cyril Malloy

[57] ABSTRACT

A system for the economic and efficient ventilating, cooling and heating of an enclosed space, such as a room or rooms within a building, through controlled ventilation of room air between an upper hotter building portion and a lower cooler building portion with the portions constituting different temperature zones in the building. The system includes a reversible ceiling fan facility and motorized inlets in the lower building portion and motorized outlets in the upper building portion, the inlets and motorized outlets being formed in the building and communicating with the exterior thereof. Air conditioning facilities are mounted within the building and include specifically an inlet for air to be cooled in the lower cooler building portion and another inlet for air which is above the inlet for the air to be cooled and which is for drawing air from the upper hotter building portion down for use as a heat sink for the condenser of the air conditioning facility and wherein the air conditioning facility includes a cold air discharge specifically disposed in the lower building portions and another exhaust above the lower cooler building portion for exhausting the sink air which had been drawn down from the upper hotter building portion.

13 Claims, 2 Drawing Sheets

COOLING, HEATING AND VENTILATION SYSTEM

BACKGROUND OF THE INVENTION

1. Field of the Invention

This invention relates to a system for temperature control and ventilation of the interior of a room, or building, utilizing forced air flow between temperature zones in a room created by natural convection phenomenon and further incorporating additional air conditioning facilities which have air intake thereto and exhaust therefrom based on the existence of the variations in air room temperature in these zones.

2. Description of the Prior Art

The prior art is replete with ventilating and air conditioning systems structured either independently or in combination with one another which are specifically designed for operation in an effective, efficient manner to condition the air within a given building structure to the extent of either heating ventilating or cooling such conditioned air. The great increase in energy costs associated with air conditioning systems, particularly for industrial-type facilities, has made the development and operation of efficient systems a necessity.

Various designs and operational characteristics have been attempted in order to provide a more efficient system incorporating a low cost of operation thereof. The following U.S. Patents disclose structures, systems and operational characteristics which are representative of prior art attempts to provide a heating and cooling system having a maximum operating efficiency in terms of cost and performance. Such U.S. Pat. Nos. include 1,925,822; 4,126,269; and 4,373,576. To a lesser extent, additional U.S. Patents are also representative of pertinent prior art attempts, as generally set forth above. Such additional U.S. Pat. Nos. include Samuelsson, 3,742,837; Otsjuka, 3,802,327; Grun et al., 4,307,776; Thunberg, 4,391,321; Beelar, 3,366,165.

By way of example, the U.S. Patent to Beelar, set forth above, discloses an air conditioning system wherein separate systems are provided to compensate for heat load passing through the wall of the structure. The contemplated separate systems accommodate heat generated internally by the lights in the room structure and for the heat and moisture produced by the people occupying the interior of the structure. The system disclosed performs adequately since it is not necessary to provide fresh air to one or more of the above set forth systems disclosed therein. The system controls the flow of heat through the walls and the roof of the building and a similar system controls the heating of the interior of the building and the interior system supplies properly-treated air to people occupying the building.

Even in light of the above prior art systems and structures, there is still a need in the industry for both a cooling and heating system which incorporate as part thereof the utilization of collected hotter room air in an upper zone of the room being conditioned and the forced travel of such heated air into a lower zone or "comfort zone" normally occupied by the people within the room or building. Similarly, a need exists for the utilization of low-cost ventilating techniques to accomplish a "cooling" mode during the hotter summer months which is equally as efficient and accomplishes adequate temperature maintenance in the comfort zone of the room or building being conditioned without the expenditure of major energy costs.

SUMMARY OF THE INVENTION

The present invention relates to a system for economically cooling ventilating and heating a given closed space such as a room, wherein the room may be used for conventional domestic purposes or industrial commercial use.

The system comprises the location and operation of ceiling fan means including at least one but preferably a plurality of fans, dependent upon the size of the space being conditioned, located in a first zone of the room. The first zone is generally defined by the upper portion of the room where the hotter air, due to convection, normally collects. The ceiling fan or fans are each specifically structured to operate in a reverse mode such that the air within the room, based upon the direction of rotation of the fans, is either forced downwardly from the first zone into a second zone defined by the lower cooler portion of the room, such as during a heating mode. Alternately, the ceiling fans, when operated in a reverse mode, would force air through the first or upper zone and out of the room space through strategically located outlet means or openings in the wall of the room and located in the upper zone. In order to provide proper ventilation and forced flow of air, inlet means are also provided in the wall of the room at a significantly lower portion than the outlet means and preferably in the first or cooler zone of the room. Such inlet and outlet means may be used in combination with a closure means in the form of motorized dampers covering such inlet and outlet openings such that the flow of air into and out of the room space and through the various zones thereof can be easily regulated.

Another important feature of the present invention is the utilization of air cooling means comprising at least one but, dependent upon the size of the room, a plurality of "packaged" air cooled air conditioning units disposed and mounted directly in the first or cooler zone of the room. Such units are specifically structured to include an air intake and an air exhaust facility. The air exhaust is specifically exposed to direct the heated exhaust air, due to the operation of the components of the air conditioning assembly, into the first zone where the hotter air in the room normally collects due to convection. Conversely, the air intake of the air conditioning facilities is located at a significantly lower portion in the room such that room air passing into the air intake is substantially cooler than normally found in the first zone or upper portions of the room.

The delivery of cooled air after passing over conventional evaporating coils, etc., through the use of blowers and the like incorporated in the packaged air conditioning units is delivered, of course, to the second zone or lower portion of the room intended to be occupied by people and also generally referred to as a "comfort zone."

Operation of the system in either the heating mode or cooling mode is accomplished by cooperative activation of the ceiling fan means, the air cooling means and the inlet and outlet means being controlled by motorized dampers or like closure structures to regulate flow of air into and out of the room from the exterior thereof. Therefore, a combination of ventilation and packaged air conditioning units and the forced flow of air throughout temperature zones within a room is an important part of the operation of the system dependent upon whether the system is intended to be operated in a cooling mode or a heating mode, both of which can be accomplished with a maximum of efficiency and a significant reduction in energy and initial costs.

The invention accordingly comprises the features of construction, combination of elements and arrangement of parts exemplified in the embodiments hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
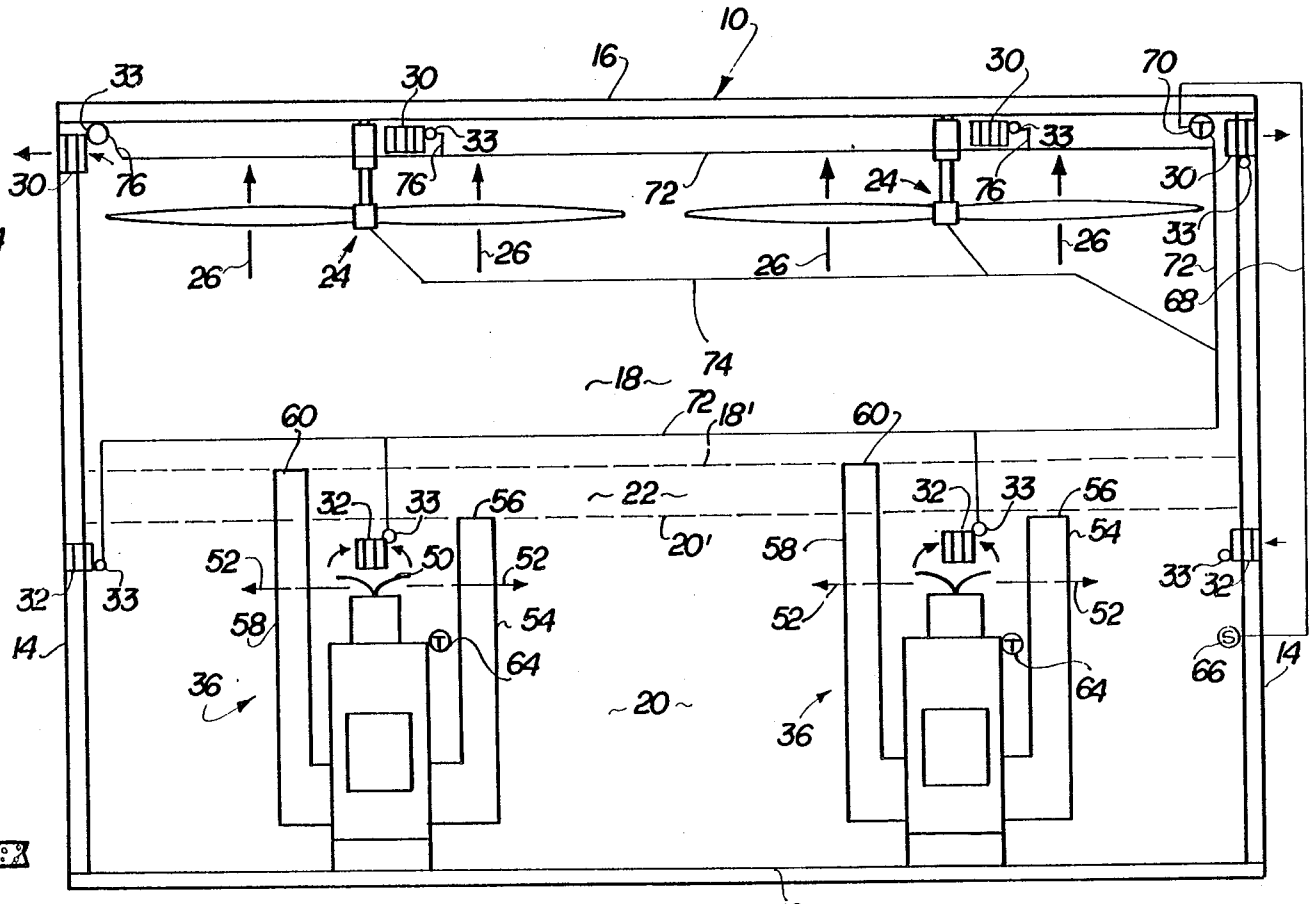
FIG. 1 is a schematic representation of the interior of a room and the various components comprising the system of the present invention.
Figure 2:
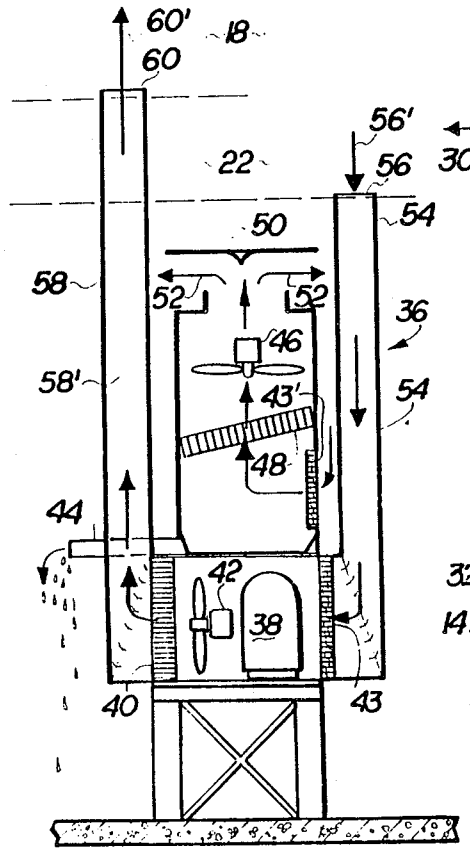
FIG. 2 is a schematic representation of a packaged air cooling facility utilized in the system of the present invention.
Figure 3:
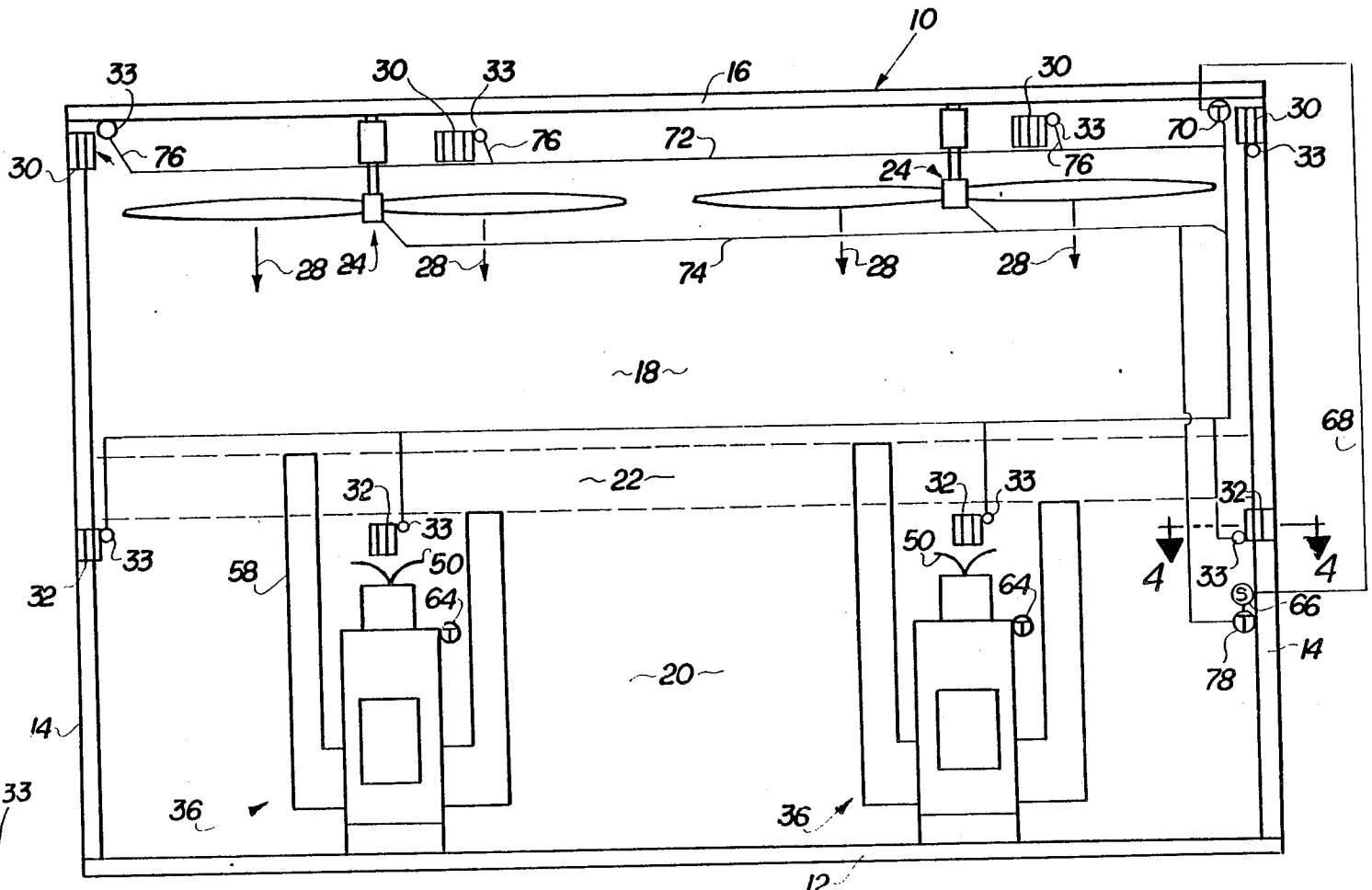
FIG. 3 is a schematic representation of the interior of the room operating in a heating mode versus the cooling mode as depicted in FIG. 1.
Figure 4:
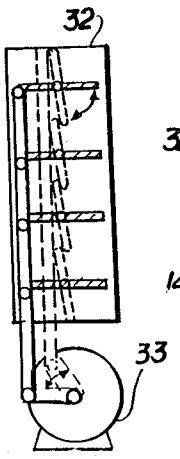
FIG. 4 is a schematic representation of the electric motors (33) and dampers at inlets 32 which are similar to the outlets 30.

As shown in FIGS. 1, 2 and 3, the system of the present invention, represented schematically for purposes of clarity, is adapted for both the heating ventilating and cooling of an interior, at least partially enclosed space of a room generally indicated as 10. The room may be defined within a building structure and intended primarily for recreational, commercial or manufacturing usage. The room 10, as schematically represented, includes a floor 12, surrounding walls 14 and a roof or ceiling structure 16.

Due to the existence of natural convection currents, as well as other forced flow of air, to be described in greater detail hereinafter, the room 10 may be considered, somewhat unprecisely, segmented into a plurality of zones or building portions. Such plurality of zones include at least a first upper zone 18 and a second lower zone 20. The first zone 18 may be defined as that upper portion of the room 10 in which generally hotter room air is collected due to natural convection currents causing the hotter air in a room or substantially enclosed space to rise. Similarly, the second zone 20 may be defined by a portion of room 10 extending upwardly from the floor 12 and includes that portion of the room where the cooler air collects, again due to the natural convection currents. A substantially imaginary boundary 18' and 20' may be considered to exist, in at least one embodiment of the present invention wherein the space or zone in between may be considered a transitional zone as at 22. It is to be emphasized that the specific location of the imaginary boundaries 18' and 20' and the size of the third; intermediate or transitional zone 22 may, of course, vary dependent upon the air flow, size of the room 10, temperature of the air entering and leaving the room, outside temperature, activity within the room, and possibly a large variety of other factors which may be in constant change thereby causing the actual boundaries of the first or upper and second or lower zone 18 and 20 to vary considerably. It is also important to note that the second or lower zone 20 may also be considered a "comfort" zone in which occupants of the room 10 spend most or all of their time when present.

Accordingly, the system of the present invention comprises the inclusion of ceiling fan means including at least one, but preferably a plurality of ceiling fans 24 mounted in the first upper zone 18 and typically attached to the ceiling or roof structure 16 so as to direct or force air flow throughout the room and, more specifically, throughout certain portions thereof. Another feature of the individual fans 24 is that they are structured to operate in a reversible mode. Accordingly, rotation of the fans in one direction or a first mode causes air flow generally representative of the directional arrows 26 in FIG. 1 and rotation of the fans 24 in the opposite direction causes forced flow of room air in the opposite direction, as indicated by directional arrows 28, as will be explained in greater detail hereinafter with reference to FIG. 3.

Another feature of the present invention is the inclusion of outlet means comprising a plurality of motorized air outlets 30 formed in the walls 14 of the room 10 as indicated in FIGS. 1 and 3. Also, the room 10 comprises an air inlet means including a plurality of motorized air inlet structures 32 also formed in the surrounding walls 14 of room 10, but disposed beneath the plurality of outlets 30 and, in a preferred embodiment, wherein the inlets 32 are formed near the top of the second lower zone 20 or zone of comfort.

Another feature of the present invention is the inclusion of a closure means in cooperation both with the outlets 30 and the plurality of inlets 32. Such closure means may be in the form of motorized dampers which are selectively positionable through operation of cooperative electric motors 33 to selectively open and close the dampers thereby regulating air flow through the outlet apertures 30 formed in the wall 14 as well as the inlet apertures 32 also formed therein.

Yet another feature of the present invention is the inclusion of air cooling means defined by at least one and preferably a plurality of packaged air conditioning assemblies generally indicated as 36. The number of air conditioning assemblies 36 is dependent, of course, upon the cooling requirements of the room 10, again based on its size, use, number of occupants, etc. As shown in FIGS. 1, 2 and 3, each of the air conditioning assemblies generally indicated as 36 include a housing in which is mounted a compressor unit 38 receiving air through a first filter 43 from an intake opening 56 as indicated by directional arrow 56' and travels along the intake conduit 54. Condenser coils 40 are located in the direct path of the forced fluid flow from the blower 42 wherein such flow, after passing over the condenser coils 40 is directed upwardly through the exhaust duct 58 as indicated by directional arrows 58'. As shown, the heated exhaust air is exited as at the end of the duct 58 as at 60 and further being indicated by directional arrow 60'. The cooling facilities associated with the air conditioning assembly 36 include intake covered by filter 43' wherein the intake for the cooling assembly is located clearly within the second or lower zone 20 or comfort zone. The evaporator or cooling coils are in the path of the incoming air flow wherein additional forced air flow is created by the evaporator fan 46 causing the cooled air to be deflected outwardly into the comfort zone 20 by a multi-directional deflector 50 as indicated by directional arrows 52. Another feature not clearly represented in the drawings of the subject invention is the ability to thermally line the housing of the air conditioning assembly and also to associate, where applicable, various sound insulation therewith. Thermostatic controls in the form of what may be considered a common thermostat 64 is associated with each of the air conditioning assemblies 36 as shown. Activation of the air conditioning assemblies 36 takes place when the temperature within the second lower or comfort zone 20 exceeds certain pre-set parameters. An exhaust of the heated air after passing through the compressor mechanism 38 is provided as at 58 with each of the air conditioning assemblies 36.

An important feature of the present invention is that the heated air exhaust 58 terminates at 60 so as to vent the heated exhaust air as at 60' into the first or upper zone 18 as clearly shown in FIGS. 1 and 2. Such takes place during the cooling mode which will be explained in greater detail hereinafter. Concurrently, air intake as at 56' passes into the intake opening 56 of the intake duct 54 of the packaged air conditioning assembly 36. Again, it is important to note that the air intake 56' is received from the third intermediate or transitional zone 22 of the room portion, wherein the room air in this transitional zone is significantly cooler than the air present in the first or upper zone 18 to which the heated exhaust air 60' is passed. A condensation remover, as at 44', is provided to remove the collected condensation from the air conditioning assembly 36 in what may be considered a generally conventional manner.

Operation of the system will first be described with regard to a cooling mode as represented schematically in FIG. 1.

Activation of the cooling mode of the system occurs by activating the thermostat 64, pre-set to activate the air conditioning assemblies 36 within certain temperature parameters. As is conventional, the temperature of the room air within the second lower zone 20 exceeding a certain temperature will cause the thermostats 64 to activate the individual air conditioning assemblies 36 causing cool air to be delivered directly to the second, lower or comfort zone 20. A switch 66 is activated, which is electrically connected to thermostat 70 mounted in the first upper zone and preferably at an upper portion thereof. The thermostat 70 is also pre-set to activate both the motorized dampers of the plurality of outlets 30 as well as the motorized dampers of the plurality of inlets by applicable conductors 72, as clearly shown. In addition, each of the plurality of ceiling fans are also connected by conductor 74 to the thermostat 70. Upon activation of the air cooling means in the form of the one or more air conditioning assemblies 36, air intake into the respective air conditioning assemblies 36 will occur as at 56 from room air within the intermediate or transitional zone 22 or, in another embodiment, directly from the upper portions of the second upper zone 20. Concurrently, the heated waste or exhaust air will be exhausted through exhaust channel 58 and out into the first upper zone 18 as at 60' (see FIG. 2). The result will be an increased buildup of the temperature of the room air within the first upper zone 18. Upon such temperature of the room air within the first upper zone 18 reaching or exceeding certain pre-set parameters, the thermostat 70 will cause activation of the motorized dampers of the inlets and the outlets, 32 and 30, respectively, and concurrently, will cause the ceiling fan means 24 to rotate in what may be considered a first mode. It should be readily apparent, therefore, that activation of the fans 24 will cause forced air flow in the direction indicated by arrows 26 while at the same time the plurality of outlets 30 will be open due to the activation of the motorized dampers thereby forcing the heated air out through the outlets 30. Concurrently, external air will be directed through the inlets 32 since the motorized dampers controlling flow through such inlets are also activated to their open position. External air will flow through the inlets 32, pass upwardly through the first upper zone 18 and out eventually through the outlets 30 due to the presence of the forced air flow and the rotation of the fan means 24 in the first mode in accordance with the directional arrows 26. The heated exhaust air emptying into the first upper zone 18 will continue as long as the operation of the air cooling means 36 continues and such heated air will be continuously vented as long as the temperature of the room air within the first upper zone 18 exceeds the pre-set parameters of the thermostat 70.

The system is capable, of course, of operating in a heating mode as schematically represented in FIG. 3. In the heating mode, the thermostats 64 are pre-set to cause deactivation of the air conditioning assemblies 36 so that they will not operate during the heating mode. Concurrently, the switch 66 is thrown to deactivate the thermostat 70 in the first upper zone 18 at the upper portion thereof. The switch 66 may be a conventional multi-pull or multi-throw switch which in turn is capable of activating an additional thermostat 78 which regulates the temperature, when the system is in the heating mode, and which is specifically interconnected electrically to the conductor 74 so as to operate the ceiling fan means 24 in the reverse mode or second mode of operation. Such second or reverse mode of operation causes forced air to flow opposite to that when the system is in the cooling mode as indicated by directional arrows 28. Accordingly, the collection of the heated air within the first upper zone 18 is forced, due to the fan means, 24 operating in the second mode, to be driven down into the second lower zone or comfort zone 20 through the transitional zone 22 and the outlets 30 and the plurality of inlets 32 are maintained, as is normally the case, in a closed condition due to closed activation of the associated motorized dampers.

The forced flow of heated air into the lower comfort zone 20 from the first upper zone 18 will cause a rise in temperature therein until temperature parameters set into thermostat 78 are reached. At this time the fans will be stopped, allowing additional build-up of heated air in upper zone 18. The thermostat 78 will again activate the fans means in the reverse mode when room temperature falls below pre-set parameters.

Now that the invention has been described,

What is claimed is:

1. An air cooling heating and ventilation system for a room or like substantially enclosed space within a building or like structure having a ceiling and a floor, said room having:

an upper room portion, a lower room portion and an intermediate room portion between the upper and lower room portions, said upper room portion extending from the ceiling downwardly to the intermediate portion and defined by the presence of air therein which is normally hotter than air in the lower room portion due at least in part to convection, said lower room portion extending from the room floor upwardly to the intermediate portion and defined by the presence of air therein which is normally cooler than air in said upper room portion due at least in part to convection, and said intermediate portion between said upper and said lower room portions being defined by the presence of air therein which is normally cooler than most of the air in the upper room portion.

a. ceiling fan means mounted in the room in the upper room portion thereof for forcing air flow between the upper and lower portions of the room, b. air cooling means including condenser means mounted in the lower room portion of the room and disposed and structured for cooling and delivering air into the room, said air cooling means including a first air intake in the lower room portion for air to be cooled and a first air outlet means for cooled air exhaust in the lower room portion;

c. outlet venting means formed in said building in the upper room portion for venting of air from the room;

d. an inlet venting means formed in said building in spaced relation to and below and in fluid communication through said building with said outlet venting means for flow of air into and out of said room;

e. said outlet venting means and said inlet venting means, each including closure means secured thereto and structured for selectively closing and opening of said venting means whereby air flow therethrough is regulated;

f. said air cooling means comprising a second air intake means and a second air outlet means, both disposed in fluid communication within the room and disposed in spaced relation to one another and at different heights within the room, said second air intake means being below said upper room portion and above said first air outlet means to draw air down from the upper room portion;

said second outlet means being above said second air intake means and above said lower room portion, and said air cooling means including conduit means in fluid flow relation with said air cooling means, said conduit means providing a fluid flow path between said second air intake means and second air outlet means and including means for drawing air from said upper room portion through said conduit means and out said second outlet means in said upper room portion to serve as a heat sink for said condenser means, whereby hot exhaust air from said second air coolihg means is delivered to said upper room portion; and g. said system being operational in at least a cooling mode, and said cooling mode at least partially defined by cool air delivered from said air cooling means through said first air outlet means into said lower room portion.

2. A system as set forth in claim 1 wherein said second air intake means of said air cooling means is disposed within said intermediate room portion between said upper and lower room portions.

3. A system as set forth in claim 1 being operative in a heating mode independently of said cooling mode, said heating mode defined at least in part by said clsure means being closed and said ceiling fan means characterized by a reversal of fan direction to cause movement of air from the hotter upper room portion to the lower cooler room portion through said intermediate portion.

4. A system as in claim 3 wherein said heating mode is further defined by air in operativeness of said air cooling means during operation of said fan means in said heating mode.

5. A system as in claim 1 wherein said cooling mode is further defined by said closure means being opened and said fan means operative in a first mode to force hotter room air from said upper room portion out of the room through said outlet vent means and external air into the room and into said upper room portion through said inlet vent means.

6. A system as in claim 5 wherein said cooling mode is further defined by said air cooling means operative to deliver cooled air to said lower room portion and intake room air from said intermediate room portion and exhausted hot air to said upper room portion.

7. A system as in claim 6 wherein said air cooling means is operative to exhaust heated air to said upper room portion concurrently to operation of said fan means and the forcing of hotter room air from said upper room portion.

8. A system as set forth in claim 7 being operative in a heating mode independently operated of said cooling mode, said heating mode defined by said closure means being closed and said ceiling fan means characterized by a reversal of fan direction to cause movement of air from the hotter upper room portion to the lower cooler room portion and through said intermediate room portion.

9. A system as in claim 8 wherein said heating mode is further defined by an inoperativeness of said air cooling means during operation of said fan means in said heating mode.

10. A system as in claim 1 further comprising a control means mounted in said room and being temperature responsive for activation of said closure means and disposition thereof between an opened and a closed position.

11. A system as in claim 10 wherein said control means comprises a thermostatic control means disposed in said upper room portion and electrically connected to said closure means for operation thereof between an open and a closed position, said closure means disposed into an open position from a normally closed position when the temperature of the room air in said upper room portion pre-set parameters.

12. A system as in claim 11 wherein said thermostatic control means is further interconnected to said fan means for operation thereof when said closure means is activated into an open position.

13. A system as in claim 12 wherein said control means further comprises supplementary thermostatic control means positioned within said lower room portion and connected for activation of said air cooling means, said supplementary thermostatic control means pre-set to activate said air cooling means when the temperature of the room air within said lower room portion exceeds pre-set parameters.

* * * * *